US006544939B1

(12) United States Patent
Haas et al.

(10) Patent No.: US 6,544,939 B1
(45) Date of Patent: Apr. 8, 2003

(54) THICKENED SILICONE DISSOLVING AGENT

(75) Inventors: Hans Haas, Stow, OH (US); Marcia Snyder, Stow, OH (US)

(73) Assignee: Permatex, Inc., Solon, OH (US)

( * ) Notice: Subject to any disclaimer, the term of this patent is extended or adjusted under 35 U.S.C. 154(b) by 130 days.

(21) Appl. No.: 09/711,788

(22) Filed: Nov. 13, 2000

(51) Int. Cl.[7] ..... C11D 1/12

(52) U.S. Cl. ..... 510/202; 510/175; 510/176; 510/376; 510/405; 510/419

(58) Field of Search ..... 510/175, 202, 510/176, 376, 405, 419; 134/3, 42; 252/500, 79.2, 79.1; 438/656

(56) References Cited

U.S. PATENT DOCUMENTS 4,399,243 A * 8/1983 Dixit et al.
4,666,615 A * 5/1987 Disch et al.
5,015,410 A * 5/1991 Sullivan
5,098,591 A * 3/1992 Stevens
5,419,848 A * 5/1995 Van Eenam
5,747,624 A 5/1998 Rubinsztajn et al. ..... 528/21
5,776,876 A * 7/1998 Garris
5,990,053 A 11/1999 Jones et al. ..... 507/238
5,994,446 A 11/1999 Graulus et al. ..... 524/484
6,339,054 B1 * 1/2002 Levitt et al.

FOREIGN PATENT DOCUMENTS

JP 407333833 A 12/1995
JP 02000061390 A 2/2000
WO WO 98/38981 9/1998

* cited by examiner

*Primary Examiner*—Gregory E. Webb
(74) *Attorney, Agent, or Firm*—Gifford, Krass, Groh, Sprinkle, Anderson & Citkowski, P.C.

(57) ABSTRACT

A silicone dissolving composition includes an organo-acid compound such as sulfonic acid or phosphinic acid, a solvent miscible with the organo-acid and able to swell a silicone, a thickener and a small amount of mineral acid. Silicone films dissolve to a liquefied mass capable of being wiped from a substrate in a matter of minutes. The removal of automotive, electrical, and construction sealants and gaskets is simplified with the use of such a silicone dissolving composition.

20 Claims, No Drawings

THICKENED SILICONE DISSOLVING AGENT

FIELD OF THE INVENTION

The present invention relates to a silicone dissolving agent and, more particularly, to a silicone dissolving agent that is thickened to remain in contact with a target silicone film.

BACKGROUND OF THE INVENTION

Silicone rubbers are used extensively in electronic, construction, and automotive applications. Silicone rubbers have the attributes of solvent and high temperature resistance, and good adhesion properties to a variety of substrates. Silicone resins and rubbers upon curing are cross-linked polymers. Whereas silicone resins often find applications as electrical insulators and water repellant paints and finishes due to exceptional resistance to weather, sunlight, oxidation and high energy radiation, silicone rubbers, such as RTV silicones, most often find applications as seals and gaskets exposed to temperature extremes and limited classes of olefinic solvents.

Single component silicone rubber mixtures commonly used have good shelf lives and vulcanize at room temperature to yield elastomers. These mixtures generally include a polymeric, usually linear siloxane, a cross linker, a plasticizer such as methyl terminated polydimethyl siloxane and optional additives such as curing accelerators, pigments, processing aids and fillers.

Silicone rubbers and resins are labor intensive to remove and replace. Chemical silicone removers have achieved considerable popularity over abrasive methods such as sandpaper abrasive disks, since abrasion modifies substrate dimensions and finish. Additionally, abrasive grit residue often enters fluid circulatory systems and engine components where the silicone served as a sealant or gasket. Chemical silicone removers have generally been strongly acidic or caustic solutions that are not only able to digest cured silicone rubbers and resins, but also attack metallic substrates such as aluminum and steel. Extreme pH silicone removers have a deleterious effect of pitting metallic substrates and damaging wood substrates as well. Solvent swelling using organic solvents such as alkanols, toluene, methylene chloride and the like are capable of swelling a cured silicone rubber or resin yet still require mechanical abrading or scraping to remove the still cured silicone. Further, environmental concerns and the difficulty of maintaining volatile organic compounds in contact with silicone rubber have limited the utility of this method as well.

Silicone removers have become available based upon organosulfonic acid solutions. While organosulfonic acid solutions are effective in digesting cured silicone rubbers and resins, the high volatility and inability to spread thick layers of such a solution onto a silicone rubber or resin have limited the utility of these solutions in automotive and construction applications. Attempts to formulate a viscous silicone rubber or resin remover by mixing a sulfonic acid compound with a polymeric glycol diether and inorganic particulate as exemplified by Japanese published application 2000061390A have met with limited success owing to incomplete silicone matrix dissolution. Thus, there exists a need for a thickened silicone remover that can be applied to various silicone coated surfaces and remain in contact with the silicone until digested, the thickened silicone remover functioning without degrading the underlying substrate.

SUMMARY OF THE INVENTION

A silicone dissolving composition includes a sulfonic acid compound, a solvent miscible with the sulfonic acid compound, an organic or organometallic material thickener and sulfuric acid. The solvent is selected to swell a silicone matrix. A silicone dissolving composition is also disclosed including alone or in combination sulfonic acid and phosphinic acid, a solvent miscible with the organo-acid, and a thickener present in a concentration sufficient to maintain the composition in dripless contact with a silicone coated substrate until the silicone is dissolved. The solvent chosen is not only miscible with the organo-acid but also is able to swell the silicone matrix. A silicone film is removed by applying a composition according to the present invention to a substrate coated with a silicone film and allowing sufficient time for the silicone film to be dissolved by the composition.

DETAILED DESCRIPTION OF THE PREFERRED EMBODIMENTS

The silicone rubber or resin dissolving agent of the present invention includes as an active ingredient from about 0.5 to 25 weight percent of an organo-acid compound, 25 to about 95 weight percent of a solvent miscible with the organo-acid compound and able to swell a cured silicone rubber or resin, a thickener present from about 2 to about 20 weight percent, and an amount of mineral acid present from about 0.025 to about 6% by weight total composition. Preferably, a silicone dissolving agent according to the present invention operates in less than two hours, and more preferably within 2–10 minutes, to digest a silicone to a consistency capable of being wiped from a substrate. Organo-acids according to the present invention include sulfonic acids, phosphinic acids, and phosphonic acids.

"Silicone" is defined herein to include polymeric silicone rubber or resin compositions which are cured or cross linked to form a polymeric matrix.

A sulfonic acid compound according to the present invention has the general formula $R_1SO_3H$ where $R_1$ is an aromatic group, or a $C_1$–$C_{24}$ alkyl or alkenyl or alkoxy group. Di- or tri- functional sulfonic acids are appreciated to be similarly operative herein. The aromatic group illustratively including phenyl, naphthyl, anthrocenyl, naphthylcenyl, penthacenyl, pyrenyl, phenanthronyl, heterocycles illustratively including pyrimidine, quinoline, isoquinoline, indole, imidazole, purine, furane, and thiophene. Preferably, the aromatic substituent is phenyl. Substituted aromatics operative in the present invention include replacement of an aromatic substituent proton with a group including $C_1$–$C_{20}$ aliphatics, alcohols, aldehydes, ketones, amines, imides and other heteroatom containing alkyl groups compatible with a hydrosulfonate. Preferably, a substituted aromatic sulfonic acid is a mono or dialkyl substituted phenyl such as dodecyl benzene sulfonic acid. A $C_1$–$C_{20}$ aliphatic substituent according to the present invention illustratively includes linear, branched, cyclic alkyls and alkenyls. It is appreciated that the choice of R substituent of a sulfonic acid according to the present invention is dictated by factors illustratively including solvent miscibility, silicone matrix interaction, storage stability, commercial availability, viscosity, and handling characteristics.

Optionally, a phosphinic or phosphonic acid having the formula $R_2PO_2H_2$ or $R_2PO_3H_2$, respectively, is utilized in the present invention in place of, or in combination with, sulfonic acid. $R_2$ is a radical of coterminus scope with $R_1$ as detailed with respect to sulfonic acid. Phenylphosphinic acid and phenylphosphonic acids are preferred phosphorus containing acids that are operative herein at levels as low as one weight percent.

A solvent miscible with a given organo-acid is chosen which is capable of swelling a cured or cross-linked silicone. Solvents according to the present invention include aliphatic and aromatic hydrocarbons that are liquid under normal storage and use conditions, illustratively including alkanes, aromatics, ketones, aldehydes, ethers, alcohols and esters. Preferably, a solvent according to the present invention has a limited odor and an evaporation rate less than about half that of n-butyl acetate at 20° C. Owing to the gelled nature of the inventive compositions and rapid silicone dissolution, solvent volatility is of less concern than in prior art compositions. Solvents according to the present invention illustratively include petroleum distillate, hexanes, $C_1$–$C_8$ alcohols and toluene.

A thickener compatible with the silicone remover solvent is provided to promote adherence of a remover according to the present invention with a silicone coated substrate. Thickeners operative in the present invention illustratively include copolymers compatible in the remover solvent, dendrimers, emulsifiers, waxes, resins, inorganics and mixtures thereof.

In addition to the organo-acid utilized herein to dissolve a silicone, it is recognized that trace quantities of sulfuric acid or phosphoric acid typically present in commercial grades of sulfonic acid, and phosphinic and phosphonic acids, respectively, are active in the silicone dissolution process. Sulfuric acid is typically found in commercial grades of sulfonic acid in concentrations ranging from about 0.5 weight percent to about 2 weight percent. While this amount of sulfuric acid is often sufficient to facilitate silicone digestion within a matter of minutes, it is appreciated that sulfuric acid is optionally added beyond this level to modify silicone dissolving agent properties according to the present invention. Preferably, sulfuric acid is added to less than a concentration at which visible substrate pitting or other forms of degradation occurs in metallic substrates such as aluminum and stainless steel. Preferably, sulfuric acid is present at less than 3 total composition weight percent. Similarly, phosphoric acid which is present in phosphinic and phosphonic acids is maintained at levels of less than 3 total composition weight percent.

Optionally, dyes, fillers, wetting agents, defoamers, fragrances and other additives are included in the formulations of the present invention.

The present invention is further detailed with reference to the following illustrative examples. These examples are intended to illustrate various aspects of the present invention and are not intended to limit the scope of the appended claims.

EXAMPLE 1

A sealable mixing chamber was charged with 150 grams of gelled Conosol C-145 (Penreco, Kams City, Pa.). Gelled Conosol C-145 is a thickened aliphatic solvent including approximately 90% hydrotreated light distillate (CAS No. 6474247-8), about 10% of an aliphatic-aromatic block copolymer thickener and about <0.1% butylated hydroxy toluene. 24 grams of technical grade dodecyl benzene sulfonic acid (DDBSA) of which about 1 gram is sulfuric acid is added to the mixing vessel in conjunction with 90 grams of petroleum distillate (CAS No. 64742-48-9). After mechanical mixing for 30 minutes, a uniform mixture was obtained. The resulting formulation after application readily removed a 4 mil thick blue RTV silicone film from an aluminum substrate within 3 minutes. After storage of the composition for 4 weeks at 50° C., comparable silicone digestion was noted within 3 minutes contact time.

EXAMPLES 2–10

The following total weight percentages were prepared and tested as to removal of 4 mil thick silicone from aluminum substrates. The compositions all wetted a wiping cloth blue after a 3 minute composition contact time with the blue RTV silicone gasket.

TABLE 1

| | Example 2 | Example 3 | Example 4 | Example 5 | Example 6 | Example 7 | Example 8 | Example 9 | Example 10 |
|---|---|---|---|---|---|---|---|---|---|
| Gelled Conosol C-145 (wt %) | 55.4 | 56.6 | 56.5 | 56.0 | 55.2 | 55.0 | 44.1 | 57.0 | 57.0 |
| DDBSA (wt %) | 20.1 | 9.1 | 8.9 | 8.9 | 20.0 | 20.0 | 16.1 | 9.0 | 1.5 |
| Odorless mineral spirits (wt %) | 24.5 | 34.0 | 33.8 | 33.5 | 24.4 | 24.2 | 38.5 | 0 | 0 |
| Added sulfuric acid (wt %) | 0 | 0.4 | 0.8 | 1.6 | 0.4 | 0.8 | 1.3 | 0* | 0* |
| Hexanes | 0 | 0 | 0 | 0 | 0 | 0 | 0 | 34.0 | 41.5* |
| Total wt % | 100.0 | 100.0 | 100.0 | 100.0 | 100.0 | 100.0 | 100.0 | 100.0 | 100.0 |
| 3 min removal | — | good | good | good | — | — | — | good | |
| 4 weeks 50° C. 3 min. removal | good | good | good | — | good | good | good | good | |

The dodecyl benzene sulfonic acid utilized in Examples 1–10 is a technical grade material containing <2% weight as sulfuric acid.

A range of formulations for the ingredients of Examples 1–10 yielding operative thickened silicone rubber formulations are summarized below in Table 2:

TABLE 2

| | Total Weight Percent |
|---|---|
| Gelled Conosol C-145 | 30–65 |
| DDBSA | 1–25 |
| Solvent | 20–50 |
| $H_2SO_4$ | 0.025–3 |

EXAMPLE 11

The composition of Example 1 was reformulated to include 2.6 grams of technical grade p-toluene sulfonic acid in place of DDBSA, 55 grams of toluene and 55 grams of isopropanol as co-solvents in place of petroleum distillate. The resulting composition completely dissolved a 2 mil blue RTV gasket from a stainless steel panel in under 5 minutes without visible damage to the panel.

EXAMPLES 12 AND 13

The composition of Example 12 was reformulated with 2.6 grams of technical grade phenylphosphinic acid (Example 12) and 2.6 grams of technical grade phenylphosphonic acid (Example 13) with similar successful silicone gasket removal.

EXAMPLE 14

As a comparative example, compositions utilizing polymeric glycol ethers and sulfonic acid as a dissolving agent for cured silicone rubber was evaluated. Dowanol EB glycol ether (Dow Chemical Company, Midland, Mich.) was utilized as a polymeric glycol ether source. Comparative Examples 1 and 2 are compared with a formulation corresponding to that of Example 1 are shown in Table 3 along performance results for these various formulations.

TABLE 3

| | Weight Percent | | |
|---|---|---|---|
| | Comparative Example A | Comparative Example B | Example 1 |
| Dowanol EB Glycol Ether | 34.0 | 91.0 | 0 |
| Biosoft S-100 (DDBSA*) | 9.0 | 9.0 | 9.0 |
| Gelled Conosol C-145 | 57.0 | 0 | 57.0 |
| Odorless Mineral Spirits | 0 | 0 | 34.0 |
| Formula appearance: | two distinct phases, components not miscible | thin, pale amber liquid | thick, smooth amber gel |
| Removal time: Film appearance at removal: | not applicable due to phase separation | ~14 hours bubbled & peeling | 5 minutes completely dissolved |

*Dodecyl benzene sulfonic acid

EXAMPLE 15

The formulation of Example 4 was reproduced with the substitution of para-toluene sulfonic acid for dodecyl benzene sulfonic acid with comparable results being obtained.

Patents and patent applications referenced herein are intended to be incorporated by reference to the full extent as if each individual patent or patent application was individually and specifically incorporated herein by reference.

It is to be understood that the preceding example are illustrative of the present invention. One skilled in the art will readily appreciate various modifications of the present invention without departing from the spirit thereof. These modifications are intended to fall within the scope of the appended claims.

What is claimed is:

1. A composition comprising:

sulfuric acid;

a sulfonic acid;

a solvent present from 25 to 95 weight percent miscible with said sulfonic acid compound, said solvent able to swell a silicone; and a thickener selected from the group consisting of: an organic, an organometallic and inorganic material.

2. The composition of claim 1 wherein said sulfonic acid compound is an aromatic sulfonic acid.

3. The composition of claim 1 wherein said solvent is selected from the group consisting of aliphatics and aromatics.

4. The composition of claim 1 wherein said solvent is a petroleum distillate.

5. The composition of claim 1 wherein said sulfonic acid is present from 1 to 25 total weight percent.

6. The composition of claim 1 wherein sulfuric acid is present from 0.025 to 6 total weight percent.

7. The composition of claim 1 wherein said thickener is selected from a group consisting of: copolymer, dendrimer, emulsifier, wax, resin, inorganic and mixtures thereof.

8. The composition of claim 1 wherein said thickener is a copolymer miscible with said solvent.

9. The composition of claim 8 wherein said copolymer is present from 5 to 20 total weight percent.

10. A composition comprising:

at least one mineral acid selected from the group consisting of sulfuric acid and phosphoric acid;

at least one organo acid selected from the group consisting of an organosulfonic acid and an organophosphorus acid;

a solvent present from 25 to 95 weight percent miscible with said organo-acid, said solvent able to swell a silicone; and a thickener present in a concentration sufficient to maintain said composition in dripless contact with a silicone coated substrate until the silicone is dissolved, said thickener selected from the group consisting of: copolymers, dendrimers, waxes, resins, inorganics and mixtures thereof.

11. The composition of claim 10 wherein said organo acid is present from about 0.5 to 15 total weight percent.

12. The composition of claim 10 wherein said mineral acid is present from about 0.025 to 3 total weight percent.

13. The composition of claim 10 wherein the organo acid is an aromatic sulfonic acid.

14. The composition of claim 10 wherein the organo acid is dodecyl benzene sulfonic acid.

15. The composition of claim 10 wherein the thickener is a copolymer miscible with said solvent.

16. The composition of claim 10 wherein the organo acid is the organophosphorus acid.

17. A composition comprising an organophosphorus acid is selected from the group consisting of phenylphosphinic acid and phenylphosphonic acid;

a solvent present from 25 to 95 weight percent miscible with said organophosphorus acid, said solvent able to swell a silicone; and a thickener present in a concentration sufficient to maintain said composition in dripless contact with a silicone coated substrate until the silicone is dissolved.

18. The composition of claim 10 wherein said solvent is a mixture of at least two solvents selected from the group consisting of: petroleum distillates, alkanes, aromatics, ketones, aldehydes, ketones, ethers, alcohols and esters.

19. The composition of claim 17 wherein said solvent is a petroleum distillate.

20. The composition of claim 17 wherein said solvent is a mixture of at least two solvents selected from the group consisting of: petroleum distillates, alkanes, aromatics, ketones, aldehydes, ketones, ethers, alcohols and esters.

* * * * *